US007917064B2

(12) United States Patent
Nagamori et al.

(10) Patent No.: US 7,917,064 B2
(45) Date of Patent: Mar. 29, 2011

(54) CHARGE ROLL, PROCESS CARTRIDGE, IMAGE FORMING APPARATUS, CHARGING METHOD, AND CLEANING METHOD OF CHARGE ROLL

(75) Inventors: Yuki Nagamori, Kanagawa (JP); Mikio Yamaguchi, Kanagawa (JP); Yasutomo Ishii, Kanagawa (JP); Mitsuo Yamamoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 799 days.

(21) Appl. No.: 11/902,293

(22) Filed: Sep. 20, 2007

(65) Prior Publication Data

US 2008/0075505 A1 Mar. 27, 2008

(30) Foreign Application Priority Data

Sep. 27, 2006 (JP) ..... 2006-263410

(51) Int. Cl.
*G03G 15/02* (2006.01)

(52) U.S. Cl. ..... 399/176

(58) Field of Classification Search ..... 399/100, 399/174, 176; 492/18
See application file for complete search history.

(56) References Cited

U.S. PATENT DOCUMENTS

| | | | | |
|---|---|---|---|---|
| 5,610,691 | A | 3/1997 | Takahashi et al. | 399/176 |
| 6,400,919 | B1 * | 6/2002 | Inoue et al. | 399/176 |
| 6,751,427 | B2 * | 6/2004 | Sugiura | 399/100 |
| 7,232,635 | B2 * | 6/2007 | Kobayashi et al. | 399/176 |
| 7,580,655 | B2 * | 8/2009 | Nukada et al. | 399/176 |

FOREIGN PATENT DOCUMENTS

| | | |
|---|---|---|
| JP | A-05-303257 | 11/1993 |
| JP | A-07-110615 | 4/1995 |
| JP | A-07-281507 | 10/1995 |
| JP | 10010857 A | 1/1998 |
| JP | 3400054 B | 2/2003 |
| JP | 2003-207966 | 7/2003 |

* cited by examiner

*Primary Examiner* — William J Royer
(74) *Attorney, Agent, or Firm* — Morgan, Lewis & Bockius LLP

(57) ABSTRACT

A charge roll includes a roll member that contacts an image carrier and rotates, the roll member including a conductive material that charges the surface of the image carrier, and the roll member having particles on the outer circumferential surface of the roll member to have a surface roughness within a predetermined range.

20 Claims, 6 Drawing Sheets

CHARGE ROLL, PROCESS CARTRIDGE, IMAGE FORMING APPARATUS, CHARGING METHOD, AND CLEANING METHOD OF CHARGE ROLL

CROSS-REFERENCE TO RELATED APPLICATIONS

This application is based on and claims priority under 35 USC 119 from Japanese Patent Application No. 2006-263410 filed Sep. 27, 2006.

BACKGROUND

1. Technical Field

The present invention relates to a charge roll, a process cartridge using the charge roll, an image forming apparatus using the charge roll, a charging method using the charge roll, and a cleaning method of the charge roll.

2. Related Art

Charging devices of electrophotographic method image forming apparatuses, such as copying machines, printers, and the like, are known that carry out contact charging of a photoreceptor by making direct contact of a conductive charge roll to the photoreceptor. Such contact charging develops substantially small amounts of ozone and nitrogen oxides, and, since power efficiency is also good, such contact charging has recently become mainstream.

SUMMARY

According to an aspect of the present invention, the charge roll comprises a roll member that contacts an image carrier and rotates, the roll member having a conductive material that charges the surface of the image carrier, and the roll member having particles on the outer circumferential surface of the roll member to have a surface roughness within a predetermined range.

BRIEF DESCRIPTION OF THE DRAWINGS

Exemplary embodiments of the present invention will be described in detail based on the following figures, wherein.

DETAILED DESCRIPTION

Explanation will now be given of exemplary embodiments of an image forming apparatus 1 of the present invention with reference to the drawings.

Figure 1:
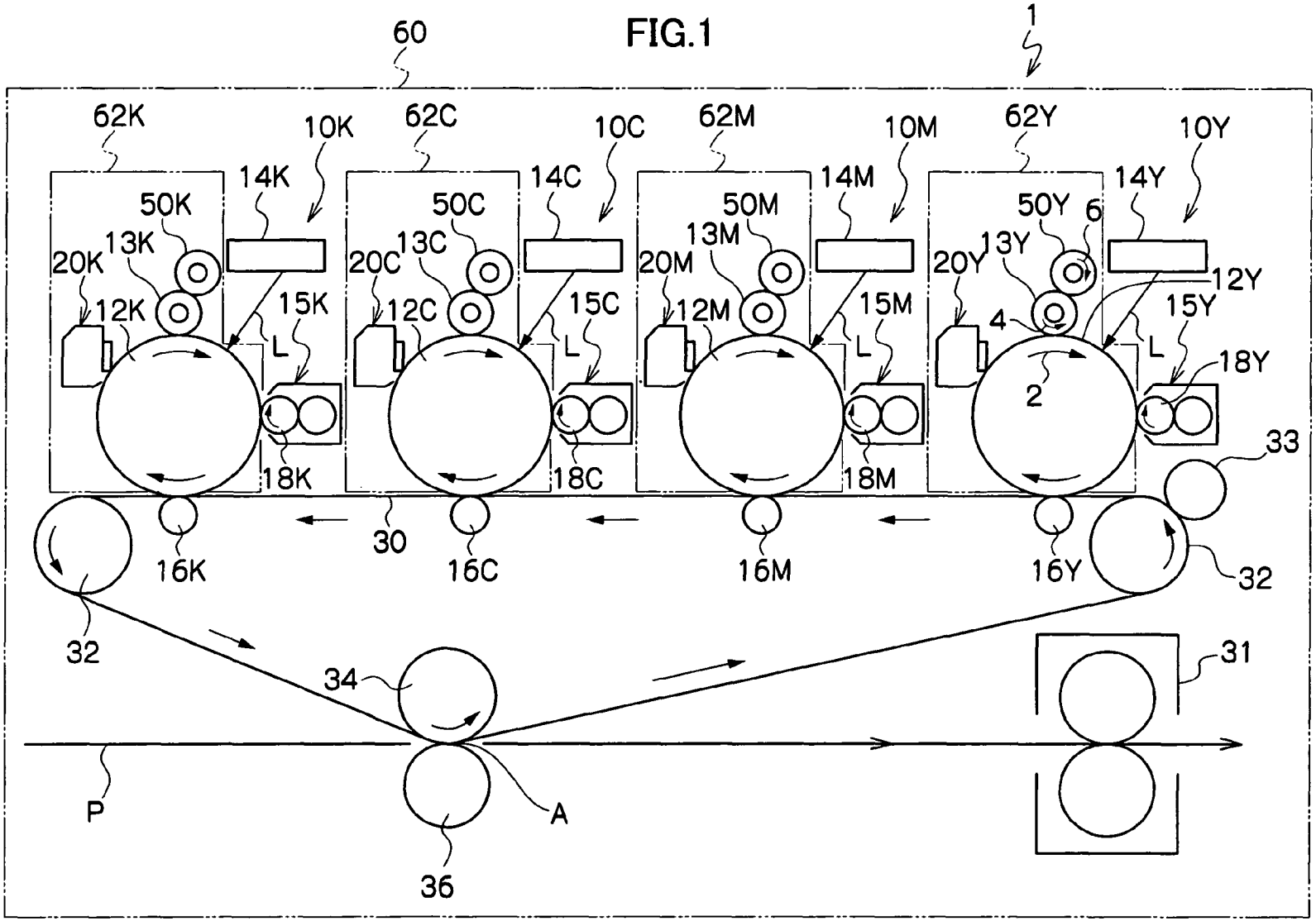
FIG. 1 is a schematic structural drawing showing an image forming apparatus according to a first exemplary embodiment of the present invention.

The image forming apparatus 1 according to a first exemplary embodiment of the present invention is shown in FIG. 1.

This image forming apparatus 1 performs image processing based on the color image information sent from an image data input device, such as a personal computer (not shown), and forms a color image on recording paper P with an electrophotographic method.

The image forming apparatus 1 is provided with image forming units 10Y, 10M, 10C, and 10K that form toner images of respective colors of yellow (Y), magenta (M), cyan (C), and black (K). Hereinafter, when it is necessary to distinguish between the colors of yellow, magenta, cyan, and black, the letters Y, M, C, and K will be added after reference numerals, and when it is not necessary to distinguish between the colors of yellow, magenta, cyan, and black, the letters Y, M, C, and K will be omitted.

The image forming units 10Y, 10M, 10C, and 10K are arranged in series in the direction of movement of an endless intermediate transfer belt 30 in the sequence of image forming units 10Y, 10M, 10C, and 10K. This intermediate transfer belt 30 is tensioned in a secondary transfer unit around a back up roll 34, for supporting the intermediate transfer belt 30 from the back surface thereof, and plural tensioning rolls 32. Moreover, the intermediate transfer belt 30 is disposed so as to be inserted between each of photoreceptor drums 12Y, 12M, 12C, and 12K, which serve as the image carriers of the image forming units 10Y, 10M, 10C, and 10K, and their respective primary transfer rolls 16Y, 16M, 16C, and 16K that are disposed opposite thereto.

Next, the configuration of the image forming units 10Y, 10M, 10C, and 10K and the operation of image formation will be described by way of the image forming unit 10Y that forms the yellow toner image.

The surface of the photoreceptor drum 12Y is uniformly charged with a charge roll 13Y. Next, a laser beam L corresponding to a yellow image is irradiated to the surface of the photoreceptor drum 12Y from a light exposure apparatus 14Y. Thereby, an electrostatic latent image corresponding to the yellow image is formed on the surface of the photoreceptor drum 12Y.

The electrostatic latent image corresponding to the yellow image on the surface of the photoreceptor drum 12Y is developed by toner carried on a development roll 18Y, disposed in a development device 15Y, to which a development bias is applied, and forms a yellow toner image. The yellow toner image is primarily transferred onto the intermediate transfer belt 30 by contact-pressure from the primary transfer roll 16Y and electrostatic attraction force due to a transfer bias applied to the primary transfer roll 16Y.

In this primary transfer, not all of the yellow toner image is transferred to the intermediate transfer belt 30; some remains as transfer residue yellow toner on the photoreceptor drum 12Y. External additives in the toner also adhere to the surface of the photoreceptor drum 12Y. A portion after primary transfer of the photoreceptor drum 12Y passes a position facing a cleaning device 20Y and the transfer residue toner on the surface of the photoreceptor drum 12Y and the like is removed. Thereafter, the surface of the photoreceptor drum 12Y is again charged by the charge roll 13Y for the next image formation cycle.

As shown in FIG. 1, in the image forming apparatus 1, the same image forming process as described above is conducted in the image forming units 10Y, 10M, 10C, and 10K at a timing in consideration of differences in the relative positions of the image forming units 10Y, 10M, 10C, and 10K, the toner images of the respective colors of yellow, magenta, cyan, and black are sequentially superposed on the intermediate transfer belt 30, and a multiple toner image is formed.

Then, the multiple toner image is transferred at once from the intermediate transfer belt 30 to the recording paper P, which is conveyed at a predetermined timing to a secondary transfer position A, by electrostatic attraction force of a secondary transfer roll 36 to which a transfer bias is applied.

The recording paper P to which the multiple toner image has been transferred is separated from the intermediate transfer belt 30 and thereafter conveyed to a fixing device 31, where the multiple toner image is fixed to the recording paper P by heat and pressure to form a full-color image.

The transfer residue toner on the intermediate transfer belt 30 that has not been transferred to the recording paper P is collected by an intermediate transfer belt cleaner 33.

In such an image forming apparatus 1, there are process cartridges 62Y, 62M, 62C, and 62K that are each made up integrally from the respective photoreceptor drum 12 disposed in each of the image forming units 10Y, 10M, 10C, and 10K, the charge roll 13, the cleaning device 20, and the like. These process cartridges 62Y, 62M, 62C, and 62K are respectively configured so as to be attachable and detachable to/from an image forming device body 60.

Figure 2:
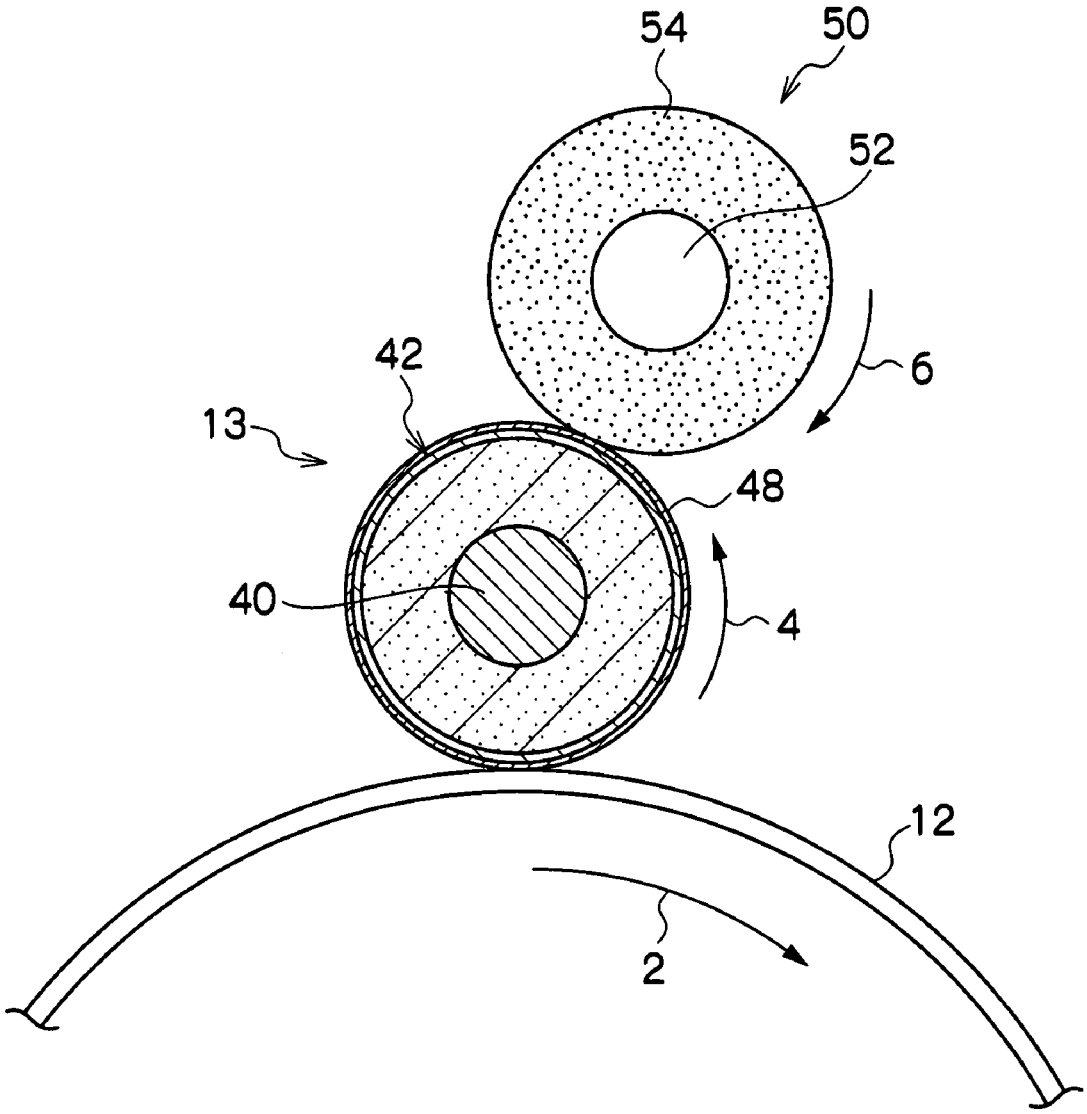
FIG. 2 is a structural drawing showing the vicinity of a charge roll used for the image forming apparatus shown in FIG. 1 and of a cleaning roll.

As shown in FIG. 2, the charge roll 13 is disposed in contact with the photoreceptor drum 12 at an upper portion of the photoreceptor drum 12. The structure of this charge roll 13 is described later. There is a cleaning roll (for example, a sponge roll) 50, which cleans the surface of the charge rolls 13, disposed at the top of the charge roll 13. The cleaning roll 50 is one in which a sponge layer 54 is formed around the perimeter of a shaft 52, and the shaft 52 is rotatably supported. The cleaning roll 50 is pressed to the charge roll 13 with a predetermined pressing force by springs (not shown) that are arranged at both ends of the shaft 52. By so doing, the sponge layer 54 of the cleaning roll 50 is elastically deformed along the circumferential surface of the charge roll 13 to form a nip portion.

A motor (not shown) is connected to a support shaft of the photoreceptor drum 12, and the photoreceptor drum 12 is driven to rotate with a clockwise rotation as viewed in FIG. 2 (the direction of the arrow 2). Moreover, the charge roll 13 is driven by the rotation of the photoreceptor drum 12 and rotates in the direction of the arrow 4. Moreover, the cleaning roll 50 is driven by the rotation of the charge roll 13 and rotates in the direction of the arrow 6. Foreign matter, such as toner and external additives on the surface of the charge roll 13, are cleaned by the driven rotation of the cleaning roll 50. It should be noted that, as an alternative configuration, it may be configured such that the charge roll 13 or the cleaning roll 50 has a motor connected thereto and is/are rotated independently.

Next, explanation will be given of details of the charge roll 13.

Figure 3:
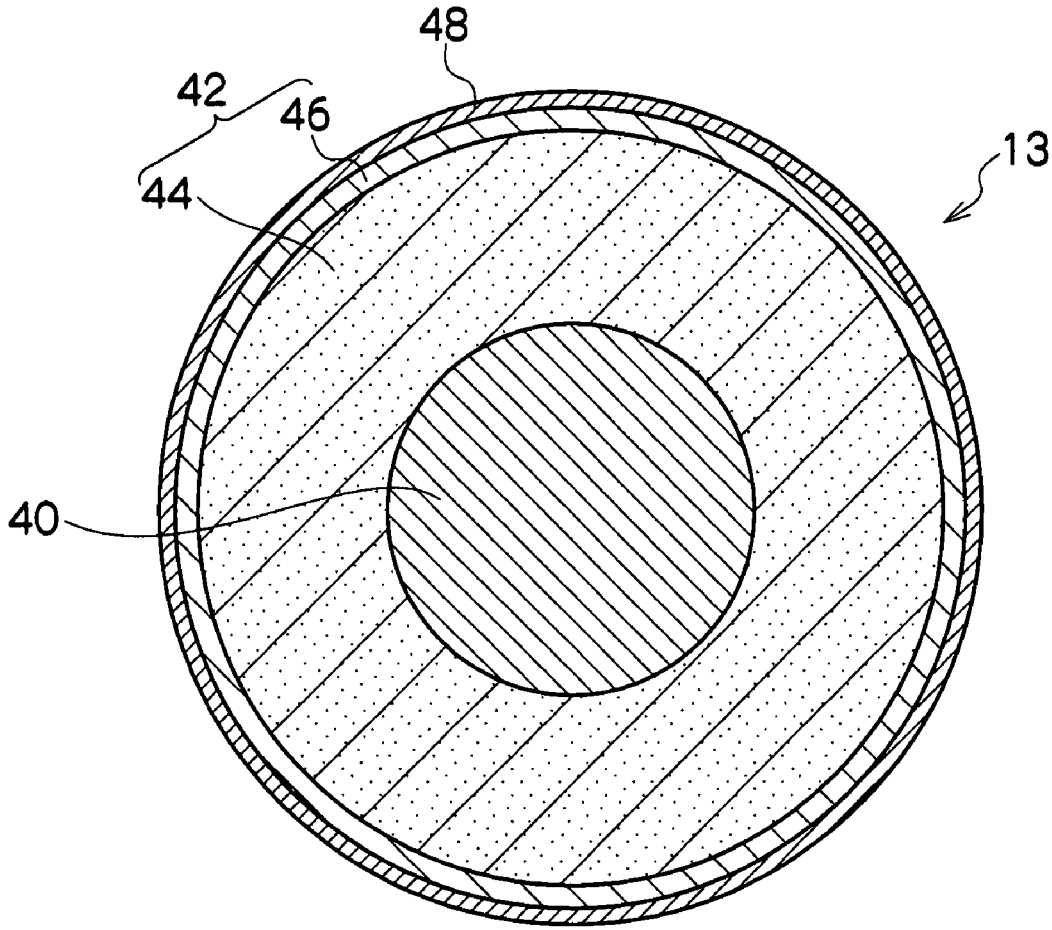
FIG. 3 is a structural drawing showing the charge roll.

The charge roll 13 is disposed in contact with the surface of the photoreceptor drum 12, and the surface of the photoreceptor drum 12 is charged by applying a direct current voltage, or a direct current voltage on which an alternating voltage is overlapped. The charge roll 13 is provided at the perimeter of a shaft 40 with an electrically resistive resilient layer 42, as shown in FIG. 3. The electrically resistive resilient layer 42 is divided, in sequence from the outside, into an electrically resistive layer 46 and a resilient layer 44 which supports the electrically resistive layer 46. Moreover, in order to impart durability and resistance to contamination to the charge roll 13, a surface layer 48 is formed to the outside of the electrically resistive layer 46.

A material that has electrical conductivity is used for the material of the shaft 40, and generally iron, copper, brass, stainless steel, aluminum, nickel, and the like are used. Moreover, materials other than metals may be used as long as they have conductivity and moderate rigidity, for example, resin moldings with dispersed conductive particles and the like therein, ceramics, and the like, may also be used. Moreover, in addition to the profile of a roller, it is also possible to use a hollow pipe shape.

A material with conductive or semiconductive properties is used for the material of the resilient layer 44, and generally resin material or rubber material is used in which conductive particles or semiconductive particles are dispersed therein. Examples of materials that may be used as resin materials include synthetic resins, such as polyester resin, acrylic resins, melamine resins, epoxy resins, urethane resins, silicone resins, urea resins, polyamide resins, and the like. Examples of materials that may be used as rubber materials include ethylene-propylene rubber, polybutadiene, natural rubber, polyisobutylene, chloroprene rubber, silicone rubber, urethane rubber, epichlorohydrin rubber, fluorosilicone rubber, and ethylene oxide rubber, or foamed materials formed by foaming the above.

Examples of particles that may be used as conductive particles or semiconductive particles include: carbon black; metals, such as zinc, aluminum, copper, iron, nickel, chromium, and titanium; metal oxides, such $ZnO\text{-}AL_2O_3$, $SnO_2$—$Sb_2O_3$, $In_2O_3$—$SnO_2$, ZnO—$TiO_2$, MgO—$Al_2O_3$, FeO—$TiO_2$, $TiO_2$, $SnO_2$, $Sb_2O_3$, $In_2O_3$, ZnO, and MgO; and ionic compounds, such as quaternary ammonium salts. Such materials may be used singly, or combinations of two or more thereof may be used. Furthermore, the following may be used as required, either used singly or in combinations of two or more thereof: inorganic fillers, such as talc, alumina, and silica; and organic fillers, such as fine particles of fluororesins or silicone rubbers.

Conductive particles or semiconductive particles dispersed in a binder resin may be used as materials for the electrically resistive layer 46 and the surface layer 48, with the electrical resistance thereof being controlled. The resistivity is preferably about $10^3$ to about $10^{14}$ Ωcm. Moreover, the average film thickness of the electrically resistive layer 46 or the surface layer 48 is preferably about 0.01 to about 1000 μm. As such a binder resin the following may be used: acrylic resins, cellulose resins, polyamide resins, methoxy methylated nylon, ethoxy methylated nylon, polyurethane resins, polycarbonate resins, polyester resins, polyethylene resins, polyvinyl resins, polyarylate resins, polythiophene resins, polyolefin resins, such as PFA, FEP and PET, styrene butadiene resins, melamine resins, epoxy resins, urethane resins, silicone resins, urea resins, and the like.

As the conductive particles or semiconductive particles dispersed in the electrically resistive layer 46 and the surface layer 48, in the same manner as in the resilient layer 44: the carbon black, metals, metal oxides, and ionic compounds, such as quaternary ammonium salts that exhibit ionic conductivity may be used, either singly or as two or more mixed together. Moreover, as required, addition may be made of: antioxidants, such as hindered phenols, and hindered amines; inorganic fillers, such as clay, kaolin, talc, silica, and alumina; organic fillers, such as fine particles of fluororesins or silicone resins; and lubricants, such as silicone oils. These may be added singly or two or more may be added. Furthermore, surfactants and charge controlling agents, and the like may be added as required.

Moreover, the following methods may be used to form these layers: a blade coating method, a wire bar coating method, a spray coating method, an immersion coating method, a bead coating method, an air knife coating method, a curtain coating method, and the like.

Figure 4:
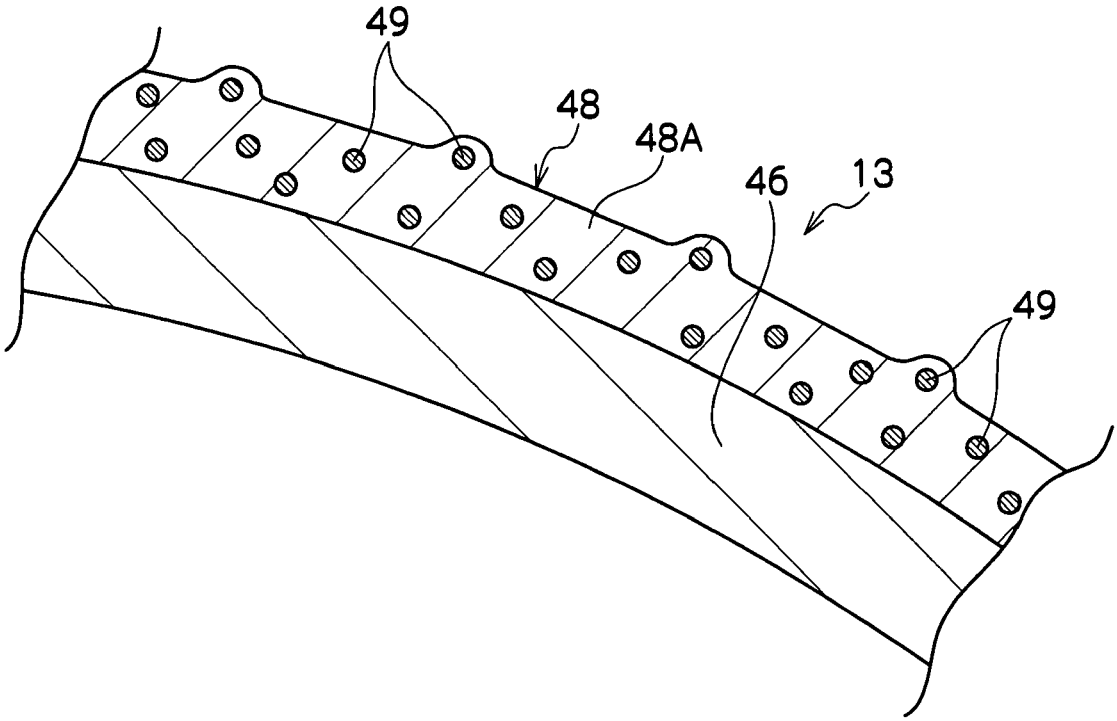
FIG. 4 is a drawing showing schematically the surface layer of the charge roll.

As shown in FIG. 4, in an aspect of the present invention, the surface layer 48 of the charge roll 13 having a predetermined surface roughness is formed by kneading the particles 49 into a binder resin 48A. That is, minute irregularities are formed in the outermost face of the surface layer 48 by the particles 49. The particles 49 may be either spherical or of undefined shape. Here, in order to make the configuration simple to understand, the binder resin 48A and the particles 49 of the surface layer 48 are shown schematically in FIG. 4.

The ten-point average surface roughness Rz of the surface layer 48 is preferably about 3 to about 12 μm, more preferable about 7 to about 12 μm, and particularly preferably about 10 to about 12 μm. By setting the ten-point average surface roughness Rz within such ranges, foreign matter, such as a toner and external additives, do not readily adhere to the surface layer 48, and the resistance of the surface layer 48 to contamination becomes high. On the other hand, when the ten-point average surface roughness Rz is less than about 3 μm there is concern that foreign matter, such as a toner and external additives, may adhere thereto. Moreover, when the ten-point average surface roughness Rz is greater than about 12 μm, toner, paper dust, and the like, readily collect in the irregular parts. Furthermore, when the ten-point average surface roughness Rz is greater than about 12 μm, local abnormal discharge occurs and uniform charging is hindered by the large height differences of the irregularities, and image defects like fine white deletions tend to occur.

Here, the ten-point average surface roughness Rz in question is the surface roughness specified according to JIS B0601 (1994). Although the ten-point average surface roughness Rz could be measured using a surface roughness tester or the like, in the present exemplary embodiment, a contact type surface roughness tester (Trade name: SURFCOM 570A, made by Tokyo Seimitsu Co., Ltd.) is used, in an environment of 23° C. and 55% RH. When measuring the surface layer 48, the measurement distance is about 2.5 mm, and using a diamond tipped stylus (5 μm R and 90° cone shape), the location is changed and measurements are carried out three times. The average of these measurements is calculated for the ten-point average surface roughness Rz of the surface layer 48.

A material with high electrical resistance is preferable for the material of the particles 49, and, for example, polymer particles, such as polyimide and methacrylic resins, and inorganic particles, such as silica, or ceramic particles may be used.

Also, it is preferable that the volume average particle size of the particles 49 is about 1% to about 50% of the average film thickness of the surface layer 48 (the length dimension of the particles 49 is about 1% to about 50% relative to the layer thickness dimension of the binder resin 48A). It is difficult to obtain the desired ten-point average surface roughness Rz if the volume average particle size of the particles 49 is less than about 1% of the average film thickness of the surface layer 48. Moreover, if the volume average particle size of the particles 49 exceeds about 50% of the average film thickness of the surface layer 48 then, depending on the blending quantity of the particles 49, it is difficult to obtain the desired ten-point average surface roughness Rz. In the present exemplary embodiment, the average film thickness of the surface layer 48 is for example, about 3 to about 15 μm, and the volume average particle size of the particles 49 is set, for example, at about 1.0 to about 7.5 μm. Here, the blending quantity of the particles 49 is set as about 5 to about 35 volume % relative to the binder resin 48A.

Here, the volume average particle size of the particles 49 is the value measured using a Coulter counter (Trade name: COULTER COUNTER TA-II, made by Coulter Co., Ltd.). In this case, measurements are made with the optimal aperture for the particle size level of the particles.

Also, the average film thickness of the surface layer 48 is the value obtained by cutting off cross sections of the surface layer 48, carrying out multiple measurements of the cross sections using a scanning electron microscope (SEM) or a transmission electron microscope (TEM), and taking the average value therefrom.

Furthermore, for the material of the particles 49, semiconductive properties may be imparted to the particles by mixing and embedding conductive fine powder into the particles. The conductive fine powders include: metals such as gold, silver, and copper; carbon black; and also metal oxides, such as powders of titanium oxide, magnesium oxide, zinc oxide, aluminum oxide, calcium carbonate, aluminum borate, potassium titanate, and calcium titanate; and fine powders formed by covering the surface of the powder of titanium oxide, zinc oxide, barium sulfate, aluminum borate, or potassium titanate, with the powder of tin oxide, carbon black, or a metal. These may be used independently or combinations of two or more may be used together. The conductive fine powder may be of the same materials as for the above conductive particles included in the binder resin 48A of the surface layer 48 (for example, carbon black and the like).

Moreover, the material of the particles 49 may be formed from the same resins as for the binder resin 48A. By using the same resin as used in the binder resin 48A, good compatibility is achieved and the adhesion becomes high between the particles 49 and binder resin 48A.

Preferably used materials for the binder resin 48A are polyvinylidene fluoride, copolymers of tetrafluoroethylene, polyester, polyimide, and copolymer nylons. Examples that may be given of such copolymer nylons are those that include therein one or more of the polymerization units Nylon 610, Nylon 11, and Nylon 12, and other polymerization units which may be included these copolymers are Nylon 6, Nylon 66, and the like. Alcohol soluble copolymerization nylon is used in the present exemplary embodiment.

Figure 5:
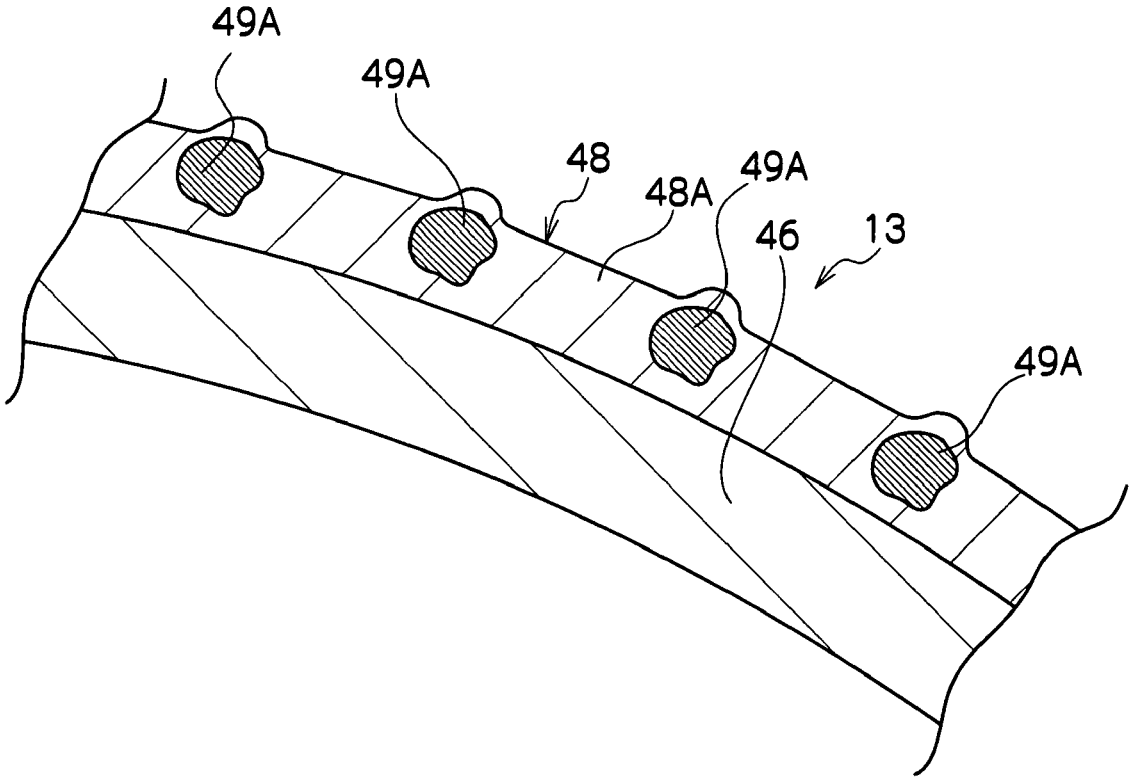
FIG. 5 is a drawing showing schematically the surface layer of the charge roll in a second exemplary embodiment of the present invention.

On the other hand, as another configuration, as shown in FIG. 5, depending on the volume average particle size and blending quantity of particles 49A, the volume average particle size of the particles 49A may also be made greater than the average film thickness of the surface layer 48. In such cases, the desired ten-point average surface roughness Rz is controlled by making a state in which a portion of the circumferential surface of the particles 49A bulges out of the surface of the surface layer 48. In FIG. 5, so that the configuration is simple to understand, the binder resin 48A and the particles 49A are shown schematically.

Figure 6:
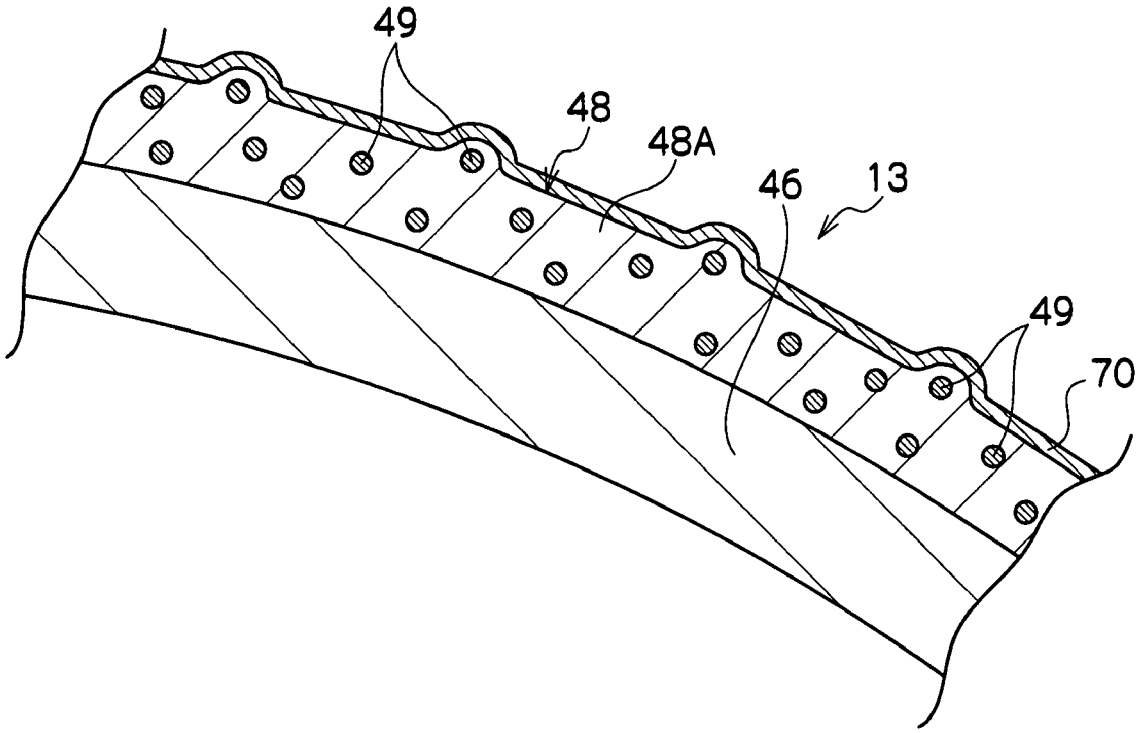
FIG. 6 is a drawing schematically showing the surface layer of the charge roll in a third exemplary embodiment of the present invention.

Or, as still another configuration, as shown in FIG. 6, a thinly coated protective layer 70 may be formed at the outside (the outermost face) of the surface layer 48 of the charge roll 13. The thickness of this protective layer 70 is preferably about 10 μm or less. Even if the protective layer 70 is formed, the ten-point average roughness of the outermost surface may be set to the predetermined range by the particles 49. It should be noted that, so that the configuration thereof may be simply understood, the binder resin 48A, the particles 49, and the protective layer 70 are shown schematically in FIG. 6.

Next, explanation will be given of the cleaning roll 50.

A free cutting steel, stainless steel, or the like is used as the material of the shaft 52 of the cleaning roll 50. The material and any surface treatment method of the shaft 52 may be selected according to the application, such as the required sliding properties, and materials that do not have conductivity may be made conductive by carrying out processing using standard treatments, such as plating treatment, and, of course, the material may be used as it is. Moreover, in order that the cleaning roll 50 may contact the charge roll 13 through the sponge layer 54 with an appropriate nip pressing force, the shaft 52 material is of a strength that does not bend during nipping, or the shaft diameter is selected to have sufficient rigidity relative to the shaft length.

The sponge layer 54 of the cleaning roll 50 includes a foam which has a porous three-dimensional configuration, with cavities and irregular portions (referred to below as cells) existing inside or at the surface thereof, and the sponge layer 54 has an elasticity. Foaming resin or rubber materials may be used for the sponge layer 54, and selection may be made from polyurethane, polyethylene, polyamide, olefins, melamine or polypropylene, NBR, EPDM, natural rubbers and styrene butadiene rubbers, chloroprene, silicone, and nitrile. Thereby, the cleaning roll 50 having many cells may be manufactured cheaply. The cleaning roll 50 efficiently cleans foreign matter, such as external additives while being driven by the rubbing friction of the charge roll 13, and at the same time it is necessary to ensure that defects are not imparted to the surface of the charge roll 13 due to the cleaning roll 50 rubbing the surface of the charge roll 13. Moreover, it is necessary to ensure that there is no shredding or breakup occurs in the sponge layer 54 over a long period of time. For this reason, polyurethane is especially preferably used as the material of the sponge layer 54, due to its tearing strength and tensile strength.

The polyurethane is not particularly limited. It suffices for there to be an accompaniment of a reaction of a polyol such as polyester polyol, polyether polyester, or acrylic polyol, and an isocyanate such as 2,4-tolylenediisocyanate, 2,6-tolylenediisocyanate, 4,4-diphenylmethane diisocyanate, tolidine diisocyanate, or 1,6-hexamethylene diisocyanate, and it is preferable that a chain extender such as 1,4-butanediol or trimethylolpropane is to be mixed in. Further, it is common to cause foaming using water and a foaming agent such as an azo compound like azodicarbonamide or azobisisobutyronitrile. Moreover, auxiliaries such as a foaming aid, a foam adjusting agent, and a catalyst may also be added as needed.

Next, explanation will now be given of the experiments for evaluating the staining properties and the cleaning characteristics of the charge roll 13.

For the charge roll 13, surface coating is carried out in the state in which the particles 49 of resin are mixed with the surface layer 48, as shown in FIG. 4, and samples are prepared by grouping into four grades of respective ten-point average roughnesses Rz, of about 1 to about 2 μm, about 3 to about 4 μm, about 7 to about 8 μm, and about 10 to about 12 to μm. Evaluation of staining properties and cleaning characteristics is performed using these samples.

As methods for evaluating staining properties and cleaning characteristics, in the image forming unit 10 of the image forming apparatus 1 shown in FIG. 1, a print test is carried out in the state in which the cleaning roll 50 is not attached, and the charge roll 13 is thereby soiled in advance. Next, only the photoreceptor drum 12, the charge roll 13, and the cleaning roll 50 are installed, and the photoreceptor drum 12 is rotated a predetermined number rotations, and any changes to the charge roll 13 surface are measured. Here, in this measuring method, grading is carried out of the changes to the degree of whiteness due to external additives adhering to the surface of the charge roll 13. G1 is good and G5 is poor, and the grade for the staining properties and cleaning characteristics is worse the higher the figure after G A new charge roll 13 is grade G0. Moreover, the allocation of grades for staining properties and for cleaning characteristics differs. For the grading of cleaning characteristics the level at which there is a satisfactory picture is G3 or below, and the when it exceeds G3 then this indicates an NG level. Also, for the grading of staining properties, the worst cases are set to G5 in the 12 evaluation levels (see Table 1), and the grades are divided up to G1 so as to be roughly equal.

Alcohol soluble copolymerization nylons are used as the binder resin 48A of the surface layer 48, carbon black as a conductive fine powder is embedded in the particles 49, and the samples are prepared by changing the particle size of the particles 49 and blending quantities to prepare sample materials. There are three levels for the average film thickness of the surface layer 48, about 3 to about 4 μm, about 8 to about 9 μm, and about 14 to about 15 μm. When the average film thickness of the surface layer 48 is about 3 to about 4 μm, particles whose volume average particle sizes are about 1.5 μm are used, and when the average film thickness of the surface layer 48 is about 8 to about 9 μm, particles whose volume average particle sizes are about 4 μm are used, and when the average film thickness about 14 to about 15 μm, particles whose volume average particle sizes are about 8 μm are used. The blending quantity of the particles is determined according to the roughness, and is about 15% to about 70% (as a weight % relative to the surface layer resin solid content).

The evaluation results for the staining properties and cleaning characteristics are shown in Table 1 and Table 2.

TABLE 1

EVALUATION OF STAINING PROPERTIES

| | | AVERAGE FILM THICKNESS OF SURFACE LAYER (μm) | | |
|---|---|---|---|---|
| | | 3~4 | 8~9 | 14~15 |
| TEN-POINT AVERAGE SURFACE ROUGHNESS (Rz) μm | 1~2 | G5 | G5 | G5 |
| | 3~4 | G3 | G4 | G4 |
| | 7~8 | G2 | G3 | G3 |
| | 10~12 | G1 | G2 | G3 |

TABLE 2

EVALUATION OF CLEANING CHARACTERISTICS

| | | AVERAGE FILM THICKNESS OF SURFACE LAYER (μm) | | |
|---|---|---|---|---|
| | | 3~4 | 8~9 | 14~15 |
| TEN-POINT AVERAGE SURFACE ROUGHNESS (Rz) μm | 1~2 | G4 | G5 | G5 |
| | 3~4 | G2 | G3 | G3 |
| | 7~8 | G2 | G2 | G3 |
| | 10~12 | G1 | G1 | G2 |

It may be seen from the results shown in Tables 1 and 2 that staining properties and cleaning characteristics may improve as the ten-point average surface roughness Rz increases.

Furthermore, a standard print test is carried out using the image forming apparatus 1 shown in FIG. 1 using the same charge roll 13, and experiments are conducted to examine the correlation between the numeric value of cleaning characteristics and actual defects (image defects). From these experiments it may be shown that for cleaning characteristics of G3 or below in Table 2, good printing may be maintained for 100,000 sheets. From the results of these experiments, it may be seen that the ten-point average surface roughness Rz is preferable 3 μm or more. Furthermore, for a ten-point average surface roughness Rz of 3 μm or more, there is no variation generated in the cleaning characteristics by the location along the shaft direction of the charge roll 13, foreign matter may be removed almost uniformly, and also the amount of foreign matter adhering itself may be reduced.

Furthermore, with regard to the upper limit of the ten-point average surface roughness Rz, the cleaning characteristics in the region close to 10 μm or more may maintain good values. However, with respect to the initial charging uniformity, if the ten-point average surface roughness Rz exceeds 12 μm, then uneven charge may occur, with white spots and the like, and initial image quality may not be achievable. From the above, it may be effective to mix the particles 49 with the surface layer 48, as described above, so that the ten-point average surface roughness Rz becomes 3 μm to 12 μm.

Next, sandblasting is used as the method for making coarse the roughness of the surface layer of the charge roll 13, and a sample (Comparative Example) is prepared so that the same ten-point average surface roughness Rz as in the Example is achieved. Evaluation of staining properties and cleaning characteristics is performed using this sample (Comparative Example).

It may be possible to achieve the desired ten-point average surface roughness Rz even if sandblasting is used as the method, however, as shown in Table 3, the resistance value that may be important for a charge roll rises to the extent of one figure under all conditions. This may show inferior electrostatic properties, especially in low temperature low humidity environments. Moreover, as shown in Table 3 besides the rise of resistance, the increase in the variation (sigma) in resistance may also be important, and generally when this exceeds 0.1, it may be difficult to achieve uniform charging.

TABLE 3

| | Ini | SANDBLASTING | EXAMPLE |
|---|---|---|---|
| DIFFERENCE IN RESISTANCE TO THAT OF Ini | — | 0.95 | 0.1 |
| VARIATION IN RESISTANCE | 0.02 | 0.27 | 0.03 |

Also it may be shown that control of the ten-point average surface roughness Rz by the particles 49 of the aspect of the present invention may have a large effect, even in comparison with the results by the sandblasting.

If the volume average particle size of the particles 49 is too small then roughness may not be readily obtained, even if the blending quantity is increased. Moreover, if the volume average particle size of the particles 49 is too large, then the particles 49 tend to readily fall out. About 1% to about 50% of the average film thickness of the surface layer 48 may be suitable for the volume average particle size of the particles 49. Moreover, by mixing and embedding carbon black as the conductive fine powder into the particles 49, the variation in the surface resistance of the charge roll 13 may be suppressed, and abnormal discharge does not readily occur.

It should be noted that, although the image forming apparatus 1 of the above exemplary embodiment is a configuration with the image forming units of yellow, magenta, cyan, and black disposed in series along the conveying direction of the intermediate transfer belt, the present invention is not limited to this structure. The present invention may also be applied, for example, to a configuration in which toner images of each color are formed one by one on a photoreceptor drum using a rotary development apparatus.

The foregoing description of the exemplary embodiment has been provided for the purposes of illustration and description. It is not intended to be exhaustive or to limit the invention to the precise forms disclosed. Obviously, many modifications and variations will be apparent to practitioners skilled in the art. The exemplary embodiment are chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charge roll comprising:

a roll member that contacts an image carrier and rotates, the roll member comprising, a conductive material that charges the surface of the image carrier, the roll member having particles on the outer circumferential surface of the roll member to have a surface roughness within a predetermined range; and a protective layer which is formed to cover the outer circumferential surface.

2. The charge roll according to claim 1, wherein the ten-point average surface roughness Rz of the surface of the protective layer is about 3 to about 12 μm.

3. The charge roll according to claim 1, wherein the volume average particle size of the particles is greater than the average film thickness of the layer that includes the particles.

4. The charge roll according to claim 1, wherein the particles are polymer particles or inorganic particles.

5. The charge roll according to claim 1, wherein the particles have a conductive fine powder and are semiconductive.

6. The charge roll according to claim 5, wherein the conductive fine powder is made of the same material as conductive particles that are contained in a binder resin.

7. A process cartridge comprising:

an image carrier; and the charge roll according to claim 1 for charging the surface of the image carrier, the process cartridge being provided to an image forming apparatus so as to be attachable and detachable.

8. The process cartridge according to claim 7, further comprising a cleaning roll that contacts the charge roll and is driven thereby so as to rotate.

9. An image forming apparatus comprising the charge roll according to claim 1.

10. A method for charging an image carrier, the method comprising:

contacting the charge roll according to claim 1 to the image carrier; and charging the image carrier by applying a voltage to the charge roll.

11. A method for cleaning a charge roll, the method comprising:

contacting the charge roll according to claim 1 to a cleaning roll; and cleaning the outer circumferential surface of the charge roll.

12. A charge roll comprising:

a roll member that contacts an image carrier and rotates, the roll member comprising, a conductive material that charges the surface of the image carrier, the roll member having particles on the outer circumferential surface of the roll member, the ten-point average surface roughness Rz of the outer circumferential surface being about 3 to about 12 μm; and a protective layer which is formed to cover the outer circumferential surface.

13. The charge roll according to claim 12, wherein the particles are polymer particles or inorganic particles.

14. The charge roll according to claim 12, wherein the particles have conductive fine powder and are semiconductive.

15. A process cartridge comprising:

an image carrier; and the charge roll according to claim 12 for charging the surface of the image carrier, the process cartridge being provided to an image forming apparatus so as to be attachable and detachable.

16. A charge roll comprising:

a roll member that contacts an image carrier and rotates, the roll member comprising, a conductive material that charges the surface of the image carrier, and the roll member having particles on the outer circumferential surface of the roll member to have a surface roughness within a predetermined range, the volume average particle size of the particles being about 1% to about 50% of the average film thickness of the layer that has the particles.

17. A process cartridge comprising:

an image carrier; and the charge roll according to claim 16 for charging the surface of the image carrier, the process cartridge being provided to an image forming apparatus so as to be attachable and detachable.

18. A charge roll comprising:

a roll member that contacts an image carrier and rotates, the roll member comprising, a conductive material that charges the surface of the image carrier, and the roll member having particles on the outer circumferential surface of the roll member to have a surface roughness, and the particles comprising the same resin as a binder resin that is included in the outer circumferential surface of the roll member.

19. A process cartridge comprising:

an image carrier; and the charge roll according to claim 18 for charging the surface of the image carrier, the process cartridge being provided to an image forming apparatus so as to be attachable and detachable.

20. A charge roll comprising:

a roll member that contacts an image carrier and rotates, the roll member comprising, a conductive material that charges the surface of the image carrier, and the roll member having particles on the outer circumferential surface of the roll member to have a surface roughness within a predetermined range;

wherein the volume average particle size of the particles is greater than the average film thickness of the layer that includes the particles.

* * * * *